US009590309B2

(12) United States Patent
Hong et al.

(10) Patent No.: US 9,590,309 B2
(45) Date of Patent: Mar. 7, 2017

(54) APERTURE-COUPLED MICROSTRIP ANTENNA AND MANUFACTURING METHOD THEREOF

(71) Applicants: Samsung Electronics Co., Ltd., Suwon-si (KR); Industry-Academic Cooperation Foundation, Yonsei University, Seoul (KR)

(72) Inventors: Young Jun Hong, Seoul (KR); Kun Kook Park, Suwon-si (KR); Kun Soo Shin, Seongnam-si (KR); Tae Wan Koo, Seongnam-si (KR); Ji Kwon Kim, Seoul (KR); Jong Gwan Yook, Seoul (KR)

(73) Assignees: Samsung Electronics Co., Ltd., Suwon-si (KR); Industry-Academic Cooperation Foundation, Yonsei University, Seoul (KR)

( * ) Notice: Subject to any disclaimer, the term of this patent is extended or adjusted under 35 U.S.C. 154(b) by 324 days.

(21) Appl. No.: 13/826,515

(22) Filed: Mar. 14, 2013

(65) Prior Publication Data

US 2013/0314283 A1 Nov. 28, 2013

(30) Foreign Application Priority Data

May 23, 2012 (KR) ..... 10-2012-0054722

(51) Int. Cl.

| | |
|---|---|
| ***H01Q 9/04*** | (2006.01) |
| ***H01P 11/00*** | (2006.01) |
| ***H01P 5/107*** | (2006.01) |

(52) U.S. Cl.
CPC ..... *H01Q 9/0421* (2013.01); *H01P 5/107* (2013.01); *H01P 11/008* (2013.01); *H01Q 9/0457* (2013.01); *Y10T 29/49016* (2015.01)

(58) Field of Classification Search
CPC .. H01Q 9/0421; H01Q 9/0457; H01Q 9/0414; H01Q 1/245; H01Q 13/106; H01Q 13/16; H01Q 13/18; H01P 5/107
See application file for complete search history.

(56) References Cited

U.S. PATENT DOCUMENTS

| | | | | |
|---|---|---|---|---|
| 4,775,866 | A * | 10/1988 | Shibata et al. | 343/700 MS |
| 5,914,693 | A * | 6/1999 | Takei et al. | 343/767 |
| 6,147,649 | A * | 11/2000 | Ivrissimtzis | H01Q 1/243 343/700 MS |
| 6,225,958 | B1 * | 5/2001 | Amano et al. | 343/767 |
| 2004/0189527 | A1 * | 9/2004 | Killen et al. | 343/700 MS |

(Continued)

FOREIGN PATENT DOCUMENTS

| | | | |
|---|---|---|---|
| JP | 2011-146781 | A | 7/2011 |
| KR | 10-2006-0017136 | A | 2/2006 |

(Continued)

*Primary Examiner* — Dameon E Levi
*Assistant Examiner* — Daniel J Munoz
(74) *Attorney, Agent, or Firm* — NSIP Law

(57) ABSTRACT

An aperture-coupled microstrip antenna and a manufacturing method thereof are provided. The aperture-coupled microstrip antenna includes a radiating patch including an aperture, and a ground plane disposed below the radiating patch. The aperture-coupled microstrip antenna further includes a shorting wall connecting the radiating patch with the ground plane, and a microstrip feeder configured to apply electromagnetic waves to the aperture.

17 Claims, 16 Drawing Sheets

(56) References Cited

U.S. PATENT DOCUMENTS

| | | | | |
|---|---|---|---|---|
| 2005/0212704 | A1* | 9/2005 | Hofmann | H01Q 1/325 343/700 MS |
| 2006/0017620 | A1* | 1/2006 | Chen | H01Q 9/40 343/700 MS |
| 2007/0296635 | A1* | 12/2007 | Popugaev et al. | 343/700 MS |
| 2012/0169562 | A1* | 7/2012 | Nysen | 343/843 |

FOREIGN PATENT DOCUMENTS

| | | | | |
|---|---|---|---|---|
| KR | 10-2008-0053081 | A | 6/2008 | |
| KR | 10-2009-0056765 | A | 6/2009 | |
| KR | 10-2009-0130521 | A | 12/2009 | |
| KR | 10-2010-0119528 | A | 11/2010 | |
| KR | 10-2010-0120661 | A | 11/2010 | |
| WO | WO 2008156429 | A1 * | 12/2008 | H01Q 1/2291 |

* cited by examiner

APERTURE-COUPLED MICROSTRIP ANTENNA AND MANUFACTURING METHOD THEREOF

CROSS-REFERENCE TO RELATED APPLICATION(S)

This application claims the benefit under 35 USC §119(a) of Korean Patent Application No. 10-2012-0054722, filed on May 23, 2012, in the Korean Intellectual Property Office, the entire disclosure of which is incorporated herein by reference for all purposes.

BACKGROUND

1. Field

The following description relates to an aperture-coupled microstrip antenna and a manufacturing method thereof.

2. Description of Related Art

In the medical field, a wireless body area network has been implanted in a human body, or attached on a surface of the human body, to collect medical data of a patient. Conditions of the patient may be continuously monitored and inspected through such a communication system, so that an emergency situation is handled. In this regard, an antenna has been used to establish a wireless link between a wireless medical device present in or on a human body and an external device present out of the human body, and to efficiently inspect human body information.

However, a wearable antenna worn on a human body is easily affected by conditions of the human body, including a high dielectric constant (high-k) and a high conductivity. Therefore, performance of the wearable antenna may be reduced when compared to an antenna in a free space. That is, a non-directional radiation pattern of the wearable antenna causes a concentration of radiated power toward the human body, thereby reducing a radiation efficiency of the wearable antenna. In addition, since the human body including the high-k and the high conductivity absorbs the radiated power, an electrical characteristic of the human body generates a mutual impedance causing poor impedance matching with the wearable antenna. Thus, when a conventional antenna technology is applied to a small wearable antenna, a radiation efficiency of the wearable antenna is no more than about 10%. Accordingly, there is a need for an antenna achieving a high radiation efficiency and a small size for application to a human body.

SUMMARY

In one general aspect, there is provided an aperture-coupled microstrip antenna including a radiating patch including an aperture, and a ground plane disposed below the radiating patch. The aperture-coupled microstrip antenna further includes a shorting wall connecting the radiating patch with the ground plane, and a microstrip feeder configured to apply electromagnetic waves to the aperture.

In another general aspect, there is provided a manufacturing method for an aperture-coupled microstrip antenna, the manufacturing method including integrally forming a radiating patch, a ground plane, and a shorting wall, and forming an aperture in the radiating patch. The manufacturing method further includes forming a microstrip feeder on the radiating patch, the ground plane, and the shorting wall, and folding the radiating patch, the ground plane, the shorting wall, and the microstrip feeder together.

In still another general aspect, there is provided a manufacturing method for an aperture-coupled microstrip antenna, the manufacturing method including forming a substrate, and forming a microstrip feeder on the substrate. The manufacturing method further includes folding the substrate and the microstrip feeder together to form three surfaces of the aperture-coupled microstrip antenna.

Other features and aspects will be apparent from the following detailed description, the drawings, and the claims.

Figure 1:
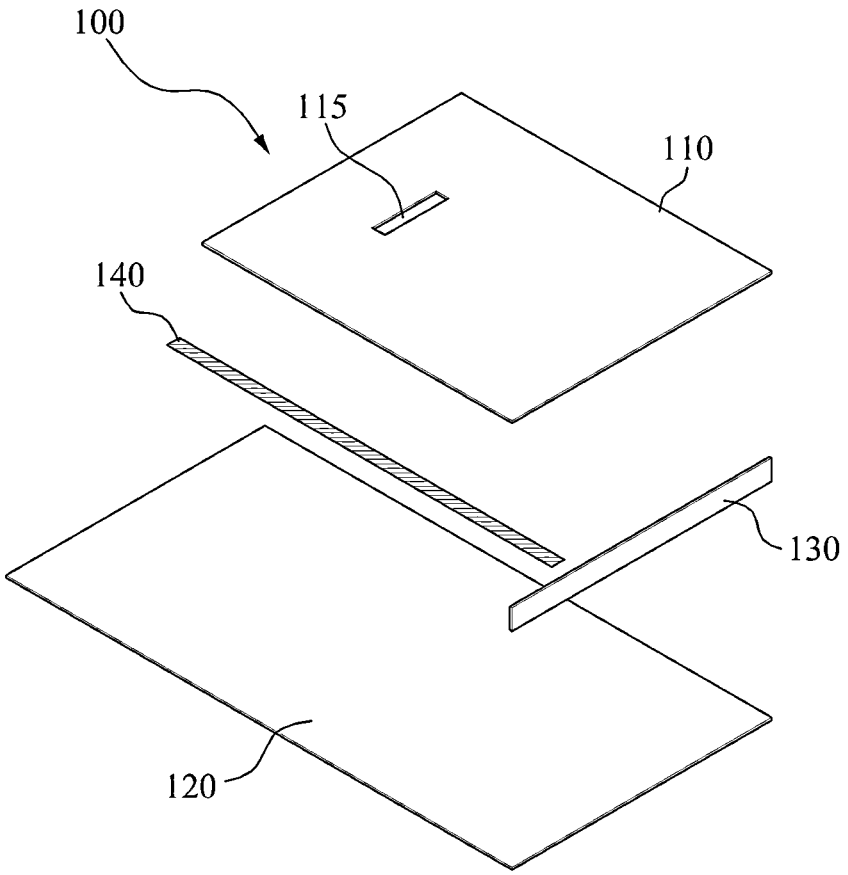
FIG. 1 is a perspective view illustrating an example of an aperture-coupled microstrip antenna.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, description of well-known functions and constructions may be omitted for increased clarity and conciseness.

Hereinafter, an aperture-coupled microstrip antenna 100 and a manufacturing method thereof will be described in detail with reference to the accompanying drawings. The aperture-coupled microstrip antenna 100 will be described as operating in a 2.4 GHz of frequency band, but is not limited thereto. The aperture-coupled microstrip antenna 100 may receive and transmit signals, using a medical wireless body area network (WBAN) technology, but is not limited thereto.

FIG. 1 is a perspective view illustrating an example of the aperture-coupled microstrip antenna 100. Referring to FIG. 1, the aperture-coupled microstrip antenna 100 includes a layered structure. In more detail, the aperture-coupled microstrip antenna 100 includes a radiating patch 110 including an aperture 115, and a ground plane 120 disposed at a lower portion of (e.g., below) the radiating patch 110. The aperture-coupled microstrip antenna 100 further includes a shorting wall 130 connecting the radiating patch 110 and the ground plane 120 with each other, and a microstrip feeder 140 configured to apply electromagnetic waves to the aperture 115, to generate radiation in the radiating patch 110.

In the aperture-coupled microstrip antenna 100, a feed network including the microstrip feeder 140, and the radiating patch 110, may be separated to achieve electromagnetic coupling. By the electromagnetic coupling, a design from a radio frequency-integrated circuit (RF-IC) to the aperture-coupled microstrip antenna 100 may be facilitated, and a coupling efficiency is increased.

The aperture 115 is included in the radiating patch 110, and is not included in the ground plane 120. If the aperture 115 is included in the ground plane 120, an electrical object approaching a lower end of the aperture-coupled microstrip antenna 100, or a signal applied at an outside of the aperture-coupled microstrip antenna 100, may directly affect the aperture-coupled microstrip antenna 100, thereby causing a reduction in performance. In more detail, when the aperture-coupled microstrip antenna 100 (e.g., the ground plane 120) is attached to a surface of a human body, since the human body includes a high dielectric constant (high-k) and a high conductivity, an interference signal is generated in the aperture-coupled microstrip antenna 100, thereby reducing a radiation efficiency of the aperture-coupled microstrip antenna 100. Accordingly, the aperture 115 is included in the radiating patch 110 to exclude the reduction in performance and to increase the radiation efficiency.

The microstrip feeder 140 is disposed between the radiating patch 110 and the ground plane 120. This configuration prevents performance reduction caused by external environments. In more detail, this configuration prevents exposure of the microstrip feeder 140 in an undesired radiation direction, that is, toward the lower end (e.g., the ground plane 120) of the aperture-coupled microstrip antenna 100, when the aperture-coupled microstrip antenna 100 is worn on the human body. Accordingly, a sudden reduction of the radiation efficiency is prevented. In addition, when the microstrip feeder 140 is disposed between the radiating patch 110 and the ground plane 120 rather than in other places, a size of the aperture-coupled microstrip antenna 100 is further reduced.

The aperture-coupled microstrip antenna 100 generates a unidirectional radiation pattern since the aperture-coupled microstrip antenna 100 includes the ground plane 120 configured to exclude the radiation at a lower portion of the ground plane 120. In more detail, downward radiation toward the lower portion of the ground plane 120 (e.g., toward the human body) is excluded by the ground plane 120, while only upward radiation is generated by the radiating patch 110, so that a concentration of radiated power toward the human body is minimized. As a consequence, the radiation efficiency of the aperture-coupled microstrip antenna 100 is increased.

As aforementioned, since the aperture-coupled microstrip antenna 100 is applied to the human body, minimization of the aperture-coupled microstrip antenna 100 is needed. That is, the aperture-coupled microstrip antenna 100 may include the shorting wall 130 to satisfy a wearable sensor platform (e.g., 70 mm×25 mm×1.5 mm). Therefore, the aperture-coupled microstrip antenna 100 includes a length corresponding to a quarter wavelength, while a conventional antenna includes a length corresponding to a half wavelength.

Figure 2A:
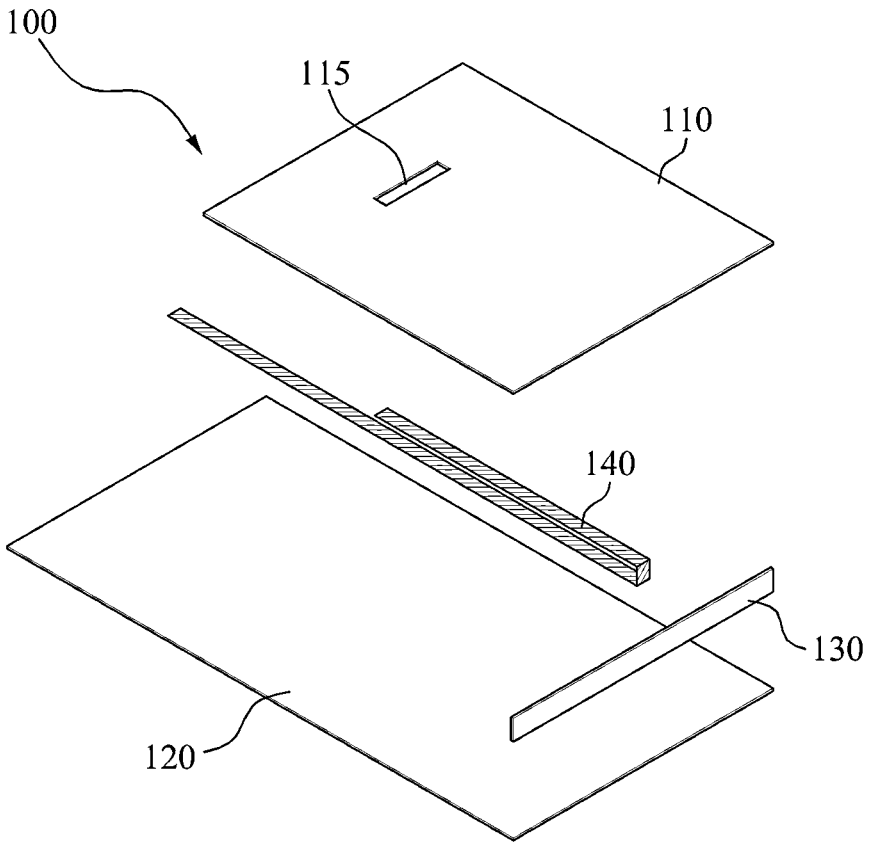
FIG. 2A is a perspective view illustrating another example of an aperture-coupled microstrip antenna.
Figure 2B:
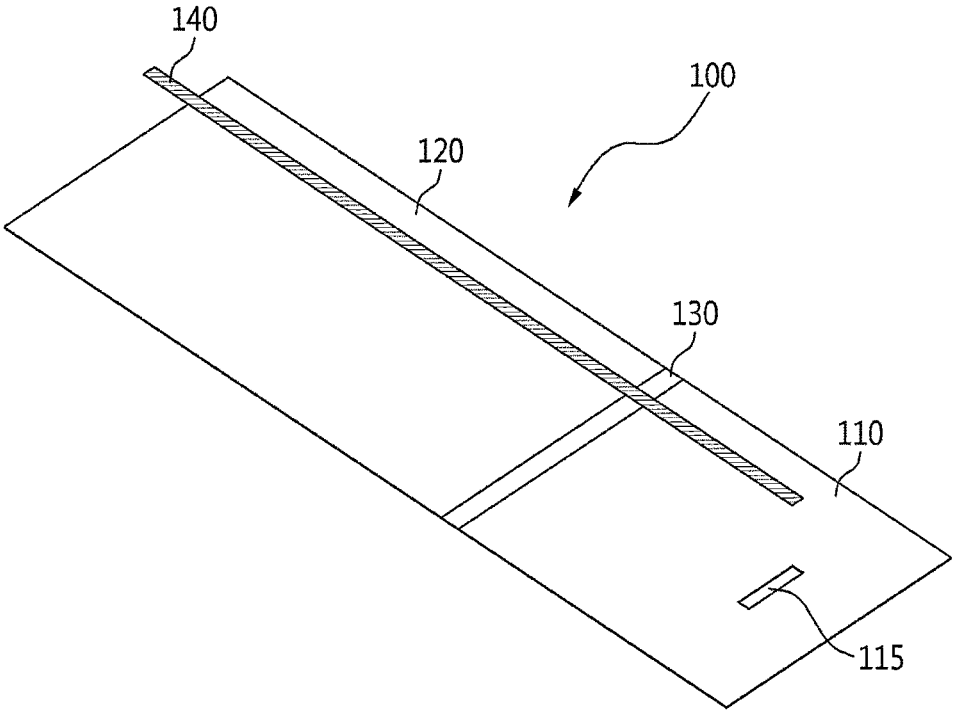
FIG. 2B is another perspective view illustrating the aperture-coupled microstrip antenna of FIG. 2A.

FIGS. 2A to 2D are a perspective view, another perspective view, a plan view, and a side view, illustrating another example of the aperture-coupled microstrip antenna 100, respectively. Referring to FIGS. 2A to 2D, the aperture-coupled microstrip antenna 100 is a foldable type. FIG. 2B illustrates the aperture-coupled microstrip antenna 100 being unfolded. Referring to FIG. 2B, the radiating patch 110 including the aperture 115, the shorting wall 130, and the ground plane 120 are integrally formed. When the radiating patch 110, the shorting wall 130, and the ground plane 120 are folded with respect to the shorting wall 130 (e.g., at edges of the shorting wall 130), the aperture-coupled microstrip antenna 100 is structured. Thus, manufacturing of the aperture-coupled microstrip antenna 100 is facilitated. That is, when an integrated substrate is folded, e.g., at two cross-sectional lines, the radiating patch 110, the shorting wall 130, and the ground plane 120 are generated spontaneously.

To manufacture the foldable aperture-coupled microstrip antenna 100, a thin substrate may be used as materials of the radiating patch 110, the ground plane 120, and the shorting wall 130. For example, the thin substrate may include a flexible printed circuits board (FPCB) or any other types of flexible substrate known to one of ordinary skill in the art.

Figure 2C:
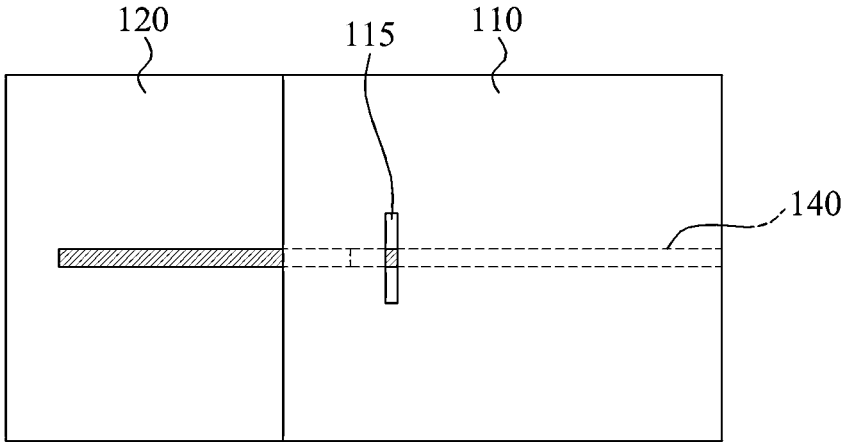
FIG. 2C is a plan view illustrating the aperture-coupled microstrip antenna of FIG. 2A.

FIG. 2C illustrates the plan view of the aperture-coupled microstrip antenna 100 when the aperture-coupled microstrip antenna 100 is folded. The radiating patch 110 including the aperture 115 covers a portion of the ground plane 120 since, e.g., the radiating patch 110 is shorter in length than the ground plane 120.

Figure 2D:
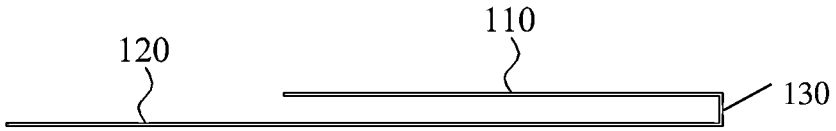
FIG. 2D is a side view illustrating the aperture-coupled microstrip antenna of FIG. 2A.

FIG. 2D illustrates the side view of the aperture-coupled microstrip antenna 100 when the aperture-coupled microstrip antenna 100 is folded. The radiating patch 110 and the ground plane 120 may be connected through the shorting wall 130, forming a flattened U-shape, although not limited thereto. The flattened U-shape includes an inner space that may be filled with air. Also, for application of the aperture-coupled microstrip antenna 100 to the human body, a thickness of the aperture-coupled microstrip antenna 100, that is, a height of the shorting wall 130 needs to be minimized. For example, the thickness may be 1.5 mm or less to suit the wearable sensor platform. In this example, the thickness is set to 0.8 mm.

Referring to FIG. 2A, the microstrip feeder 140 will be described. As described with reference to FIG. 1, the microstrip feeder 140 is disposed between the radiating patch 110 and the ground plane 120. In this example of FIGS. 2A, 2C, and 2D, the microstrip feeder 140 is also folded when the radiating patch 110, the shorting wall 130, and the ground plane 120 are folded. Accordingly, different from a microstrip feeder that includes the length corresponding to the quarter wavelength and that has been expanded to an outside of the aperture-coupled microstrip antenna 100 to achieve impedance matching, the microstrip feeder 140 is disposed directly in the aperture-coupled microstrip antenna 100 to achieve impedance matching. Therefore, the size of the aperture-coupled microstrip antenna 100 is minimized.

Although the microstrip feeder 140 is described to be foldable, the microstrip feeder 140 is not limited thereto. For example, a portion of the microstrip feeder 140 may overlap with a remaining portion of the microstrip feeder 140. That is, the microstrip feeder 140 may be inserted in the aperture-coupled microstrip antenna 100 in a folded state.

Figure 3:
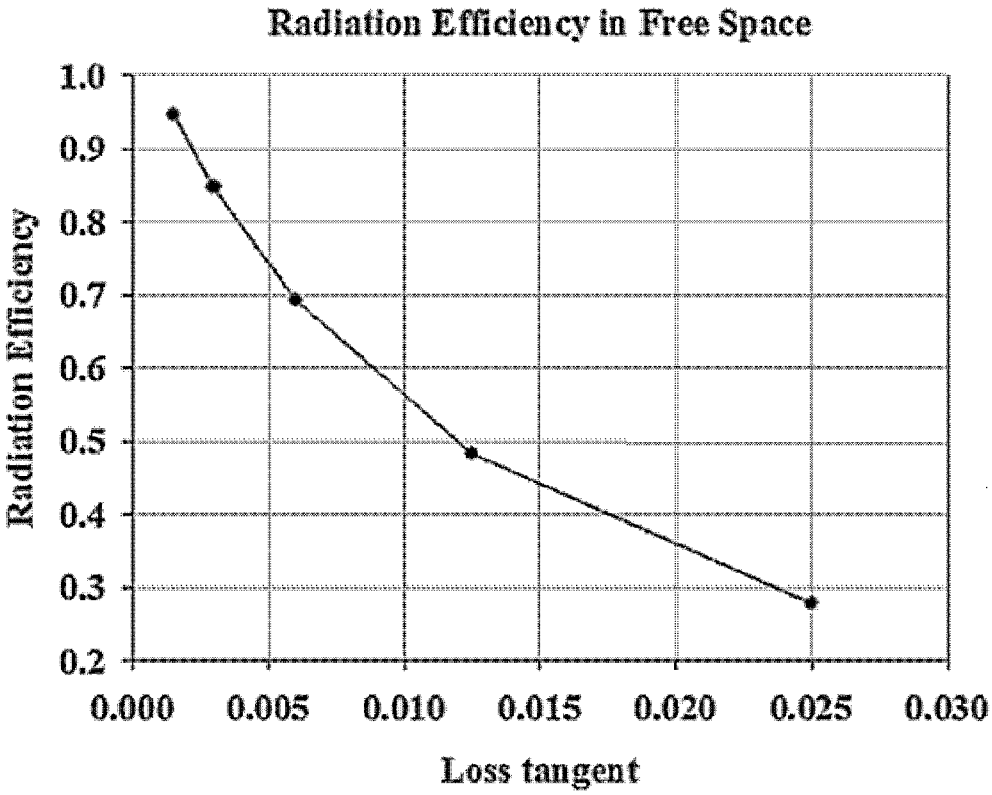
FIG. 3 is a graph illustrating an example of a relationship between a loss tangent and a radiation efficiency of an aperture-coupled microstrip antenna in a free space.

FIG. 3 is a graph illustrating an example of a relationship between a loss tangent and a radiation efficiency of an aperture-coupled microstrip antenna in a free space. As shown in FIG. 3, the loss tangent is inversely proportional to the radiation efficiency. That is, when a substrate of the aperture-coupled microstrip antenna includes a material including a low loss tangent, the radiation efficiency of the aperture-coupled microstrip antenna is increased or high.

A conventional substrate of an antenna may include a multilayer polyimide film or silicone to maintain a thin and flexible structure. However, a radiation efficiency of the antenna is highly influenced by dielectric loss. For example, when the substrate includes PolyDiMethylSiloxane (PDMS), a loss tangent of the antenna is 0.025. Therefore, an electric field (E-field) is not formed at an external area of the substrate, and a considerable amount of energy is stored in an internal area of the substrate, thereby reducing the radiation efficiency.

Accordingly, the substrate of the radiating patch 110, the shorting wall 130, and the ground plane 120 of FIGS. 1 to 2D may include a material including a loss tangent of less than 0.025. For example, the substrate may include a Kapton polyimide core including a dielectric constant similar to a dielectric constant of the PDMS but a loss tangent of 0.0035, which is much lower than the loss tangent of the PDMS. In addition, to further increase the radiation efficiency of the aperture-coupled microstrip antenna 100 in a thin structure, an inner space formed between the radiating patch 110 and the ground plane 120 may be filled with air, although not limited thereto.

Radiation characteristics of the aperture-coupled microstrip antenna 100 are shown in FIGS. 4A to 6. The aperture-coupled microstrip antenna 100 used to determine the radiation characteristics includes a width of 26 mm, a length of 17 mm, and a thickness of 0.8 mm.

Figure 4A:
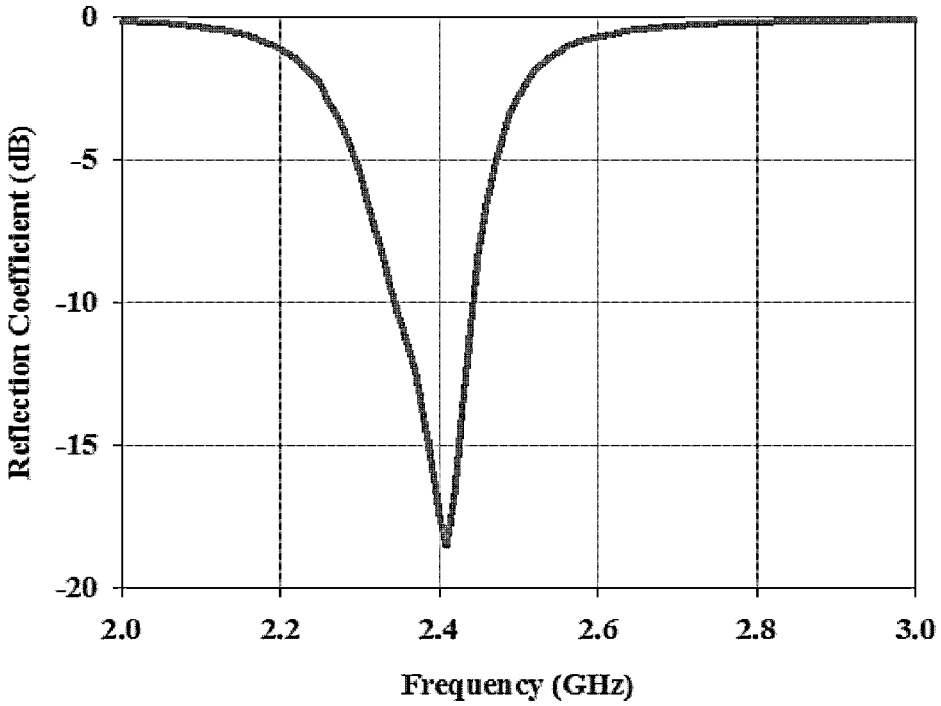
FIG. 4A is a graph illustrating an example of a reflection coefficient of an aperture-coupled microstrip antenna in a free space.
Figure 4B:
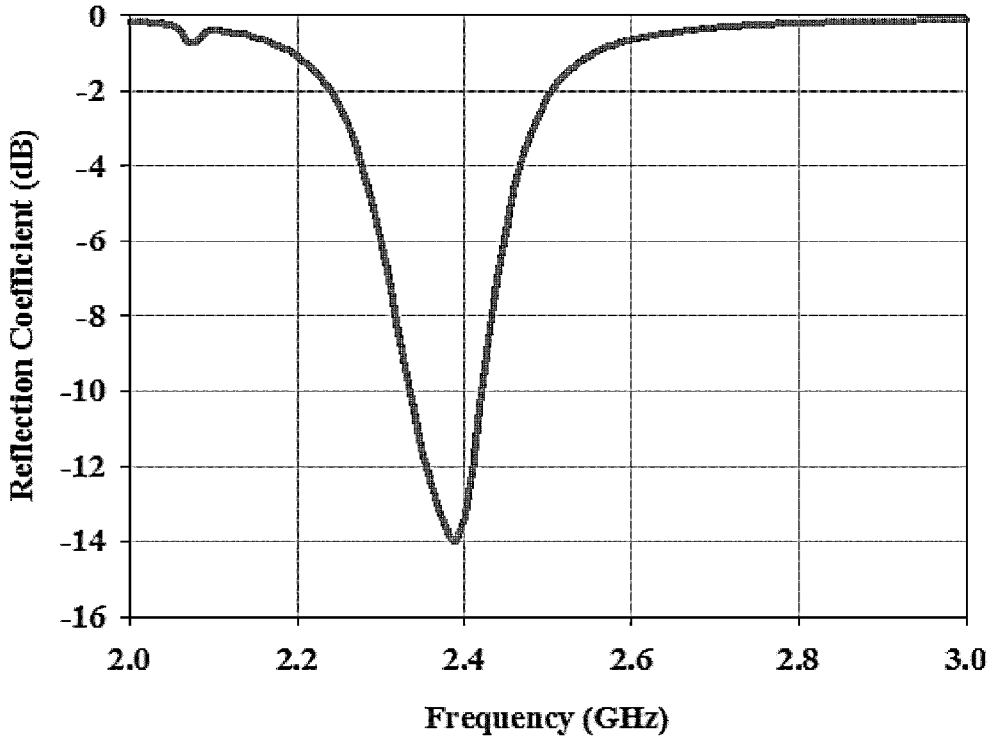
FIG. 4B is a graph illustrating an example of a reflection coefficient of an aperture-coupled microstrip antenna on a surface of a human body.

FIGS. 4A and 4B are graphs illustrating examples of reflection coefficients of the aperture-coupled microstrip antenna 100 in a free space and on a surface of a human body, respectively. The reflection coefficient refers to a parameter indicating a reflective loss of power among power applied based on frequencies of the aperture-coupled microstrip antenna 100. For example, when the reflection coefficient is −10 dB, this means 90% of power is transmitted to the aperture-coupled microstrip antenna 100 in a corresponding frequency, while 10% of the power is reflected. As shown in FIGS. 4A and 4B, the reflective loss of power is lowest at around 2.4 GHz. That is, aperture-coupled microstrip antenna 100 may be provided in a frequency band of 2.4 GHz, although not limited thereto. In addition, the reflection coefficients measured in the free space and on the surface of the human body are not much different. That is, an influence of the human body to the aperture-coupled microstrip antenna 100 is minimal when the aperture-coupled microstrip antenna 100 is applied to the human body. Accordingly, the aperture-coupled microstrip antenna 100 is a high efficiency antenna causing almost no loss of power.

Figure 5A:
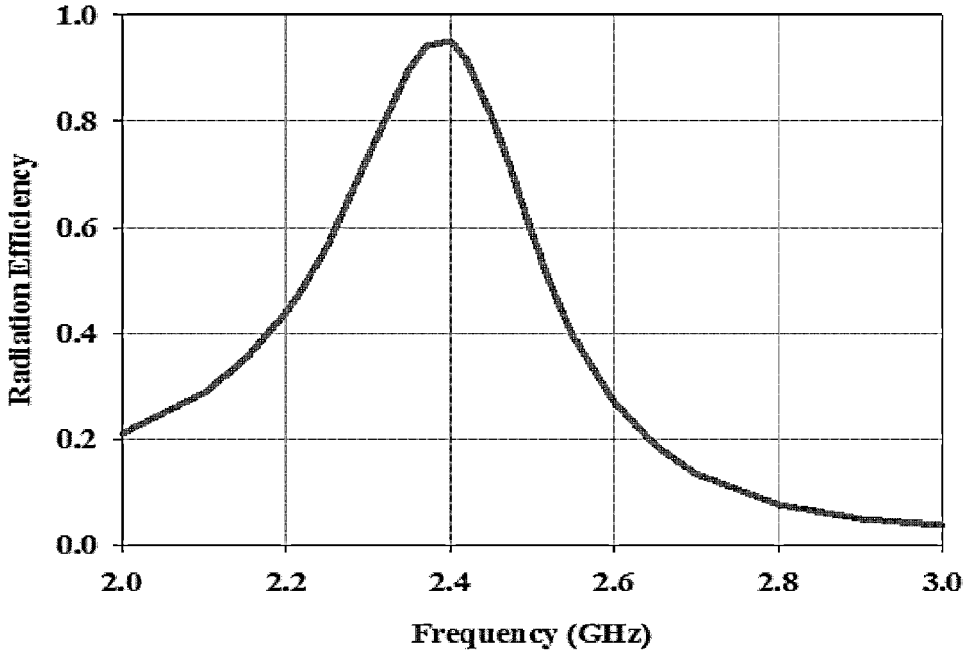
FIG. 5A is a graph illustrating an example of a radiation efficiency of an aperture-coupled microstrip antenna in a free space.
Figure 5B:
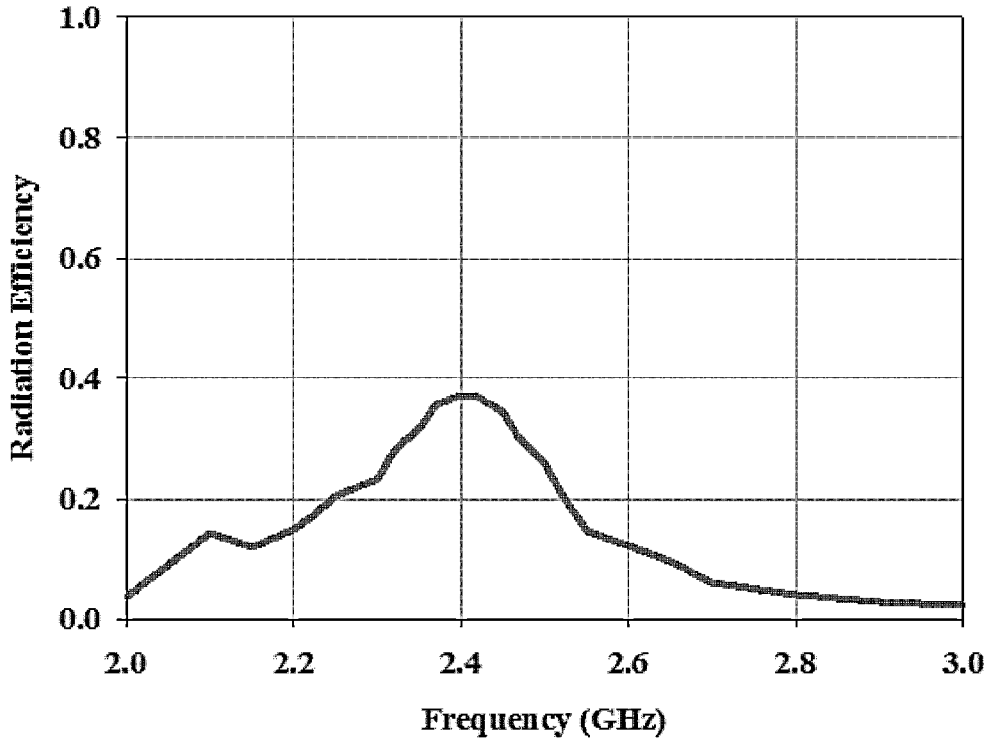
FIG. 5B is a graph illustrating an example of a radiation efficiency of an aperture-coupled microstrip antenna on a surface of a human body.

FIGS. 5A and 5B are graphs illustrating examples of radiation efficiencies of the aperture-coupled microstrip antenna 100 in a free space and on a surface of a human body, respectively. With respect to a frequency band of 2.4 GHz, the radiation efficiency measured in the free space is 95%, and the radiation efficiency measured on the surface of the human body is 39%. Compared to a radiation efficiency of a convention antenna that is 10% or less, the radiation efficiency of the aperture-coupled microstrip antenna 100 is considerably increased. Additionally, since the radiation efficiencies measured in the free space and on the surface of the human body correspond to each other, a radiation mechanism of the aperture-coupled microstrip antenna 100 is not affected when the aperture-coupled microstrip antenna 100 is applied to the human body.

Figure 6A:
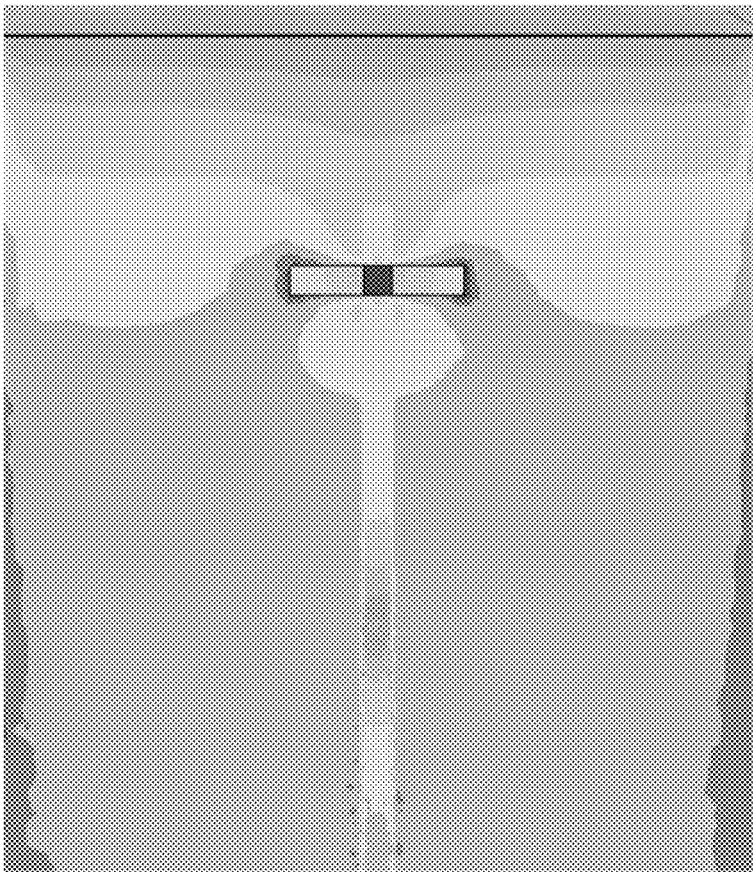
FIG. 6A is a diagram illustrating an example of a back lobe generated in an aperture-coupled microstrip antenna.
Figure 6B:
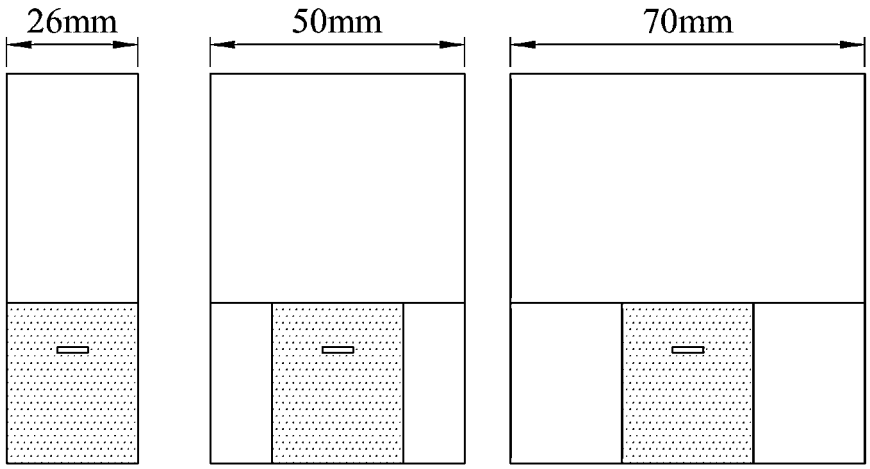
FIG. 6B is a diagram illustrating an example of an adjustment of a width of a ground plane of an aperture-coupled microstrip antenna.

FIG. 6A is a diagram illustrating an example of a back lobe generated in the aperture-coupled microstrip antenna 100, and FIG. 6B is a diagram illustrating an example of an adjustment of a width of the ground plane 120 of the aperture-coupled microstrip antenna 100. The aperture-coupled microstrip antenna 100 is characterized by a small size. However, when the ground plane 120 is too small, the back lobe of radiation is generated, consequently reducing a radiation efficiency of the aperture-coupled microstrip antenna 100. FIG. 6A shows the back lobe generated when the width of the ground plane 120 is 26 mm. With the width of 26 mm, the radiation efficiency is 39% and already satisfactory. However, to achieve a higher radiation efficiency, a human body absorption shielding effect of the ground plane 120 needs to be ensured to minimize the back lobe. To ensure the human body absorption shielding effect, the width of the ground plane 120 may be increased from 26 mm to 50 mm or from 26 mm to 70 mm, as illustrated in FIG. 6B.

Figure 6C:
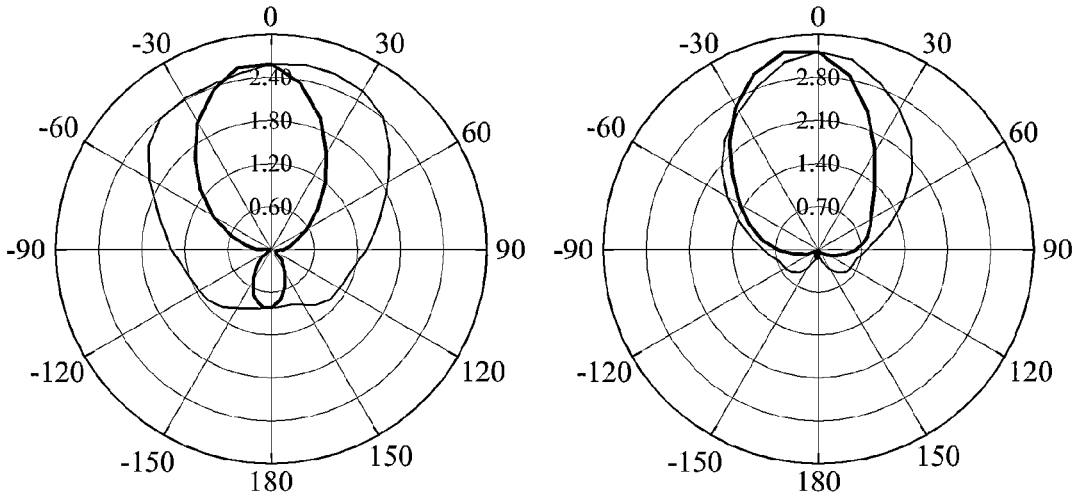
FIG. 6C are a left diagram illustrating an example of a back lobe generated when a width of a ground plane is 26 mm, and a right diagram illustrating an example of a back lobe generated when the width is 50 mm.

FIG. 6C are a left diagram illustrating an example of the back lobe generated when the width of the ground plane 120 is 26 mm, and a right diagram illustrating an example of the back lobe generated when the width is 50 mm. As shown in FIG. 6C, as the width of the ground plane 120 increases, an intensity of the back lobe is reduced.

Figure 6D:
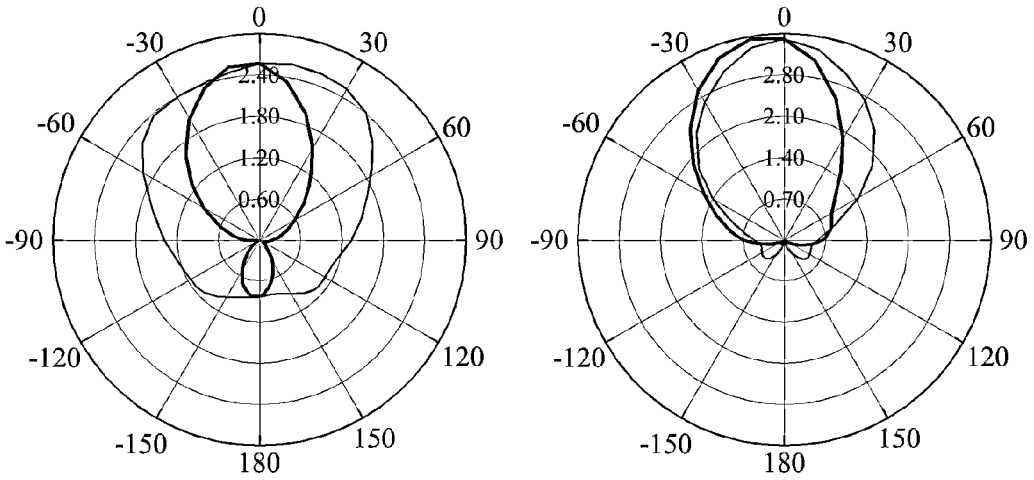
FIG. 6D are a left diagram illustrating an example of a back lobe generated when a width of a ground plane is 26 mm, and a right diagram illustrating an example of a back lobe generated when the width is 70 mm.

FIG. 6D are a left diagram illustrating an example of the back lobe generated when the width of the ground plane 120 is 26 mm, and a right diagram illustrating an example of the back lobe generated when the width is 70 mm. Also, the intensity of the back lobe is reduced as the width of the ground plane 120 increases.

That is, when the width of the ground plane is increased to 50 mm or 70 mm, the back lobe is reduced, accordingly increasing the radiation efficiency. Since the width of 70 mm is still applicable to the human body, the radiation efficiency of the aperture-coupled microstrip antenna 100 may be further increased by adjusting the width of the ground plane 120 depending on circumstances. For example, the radiation efficiency may be maximized up to about 60% by adjusting the width of the ground plane 120 within a range of the wearable sensor platform. However, since the foregoing numerical values are only by way of example, the measurements of the aperture-coupled microstrip antenna 100 are not limited to the numerical values.

Figure 7A:
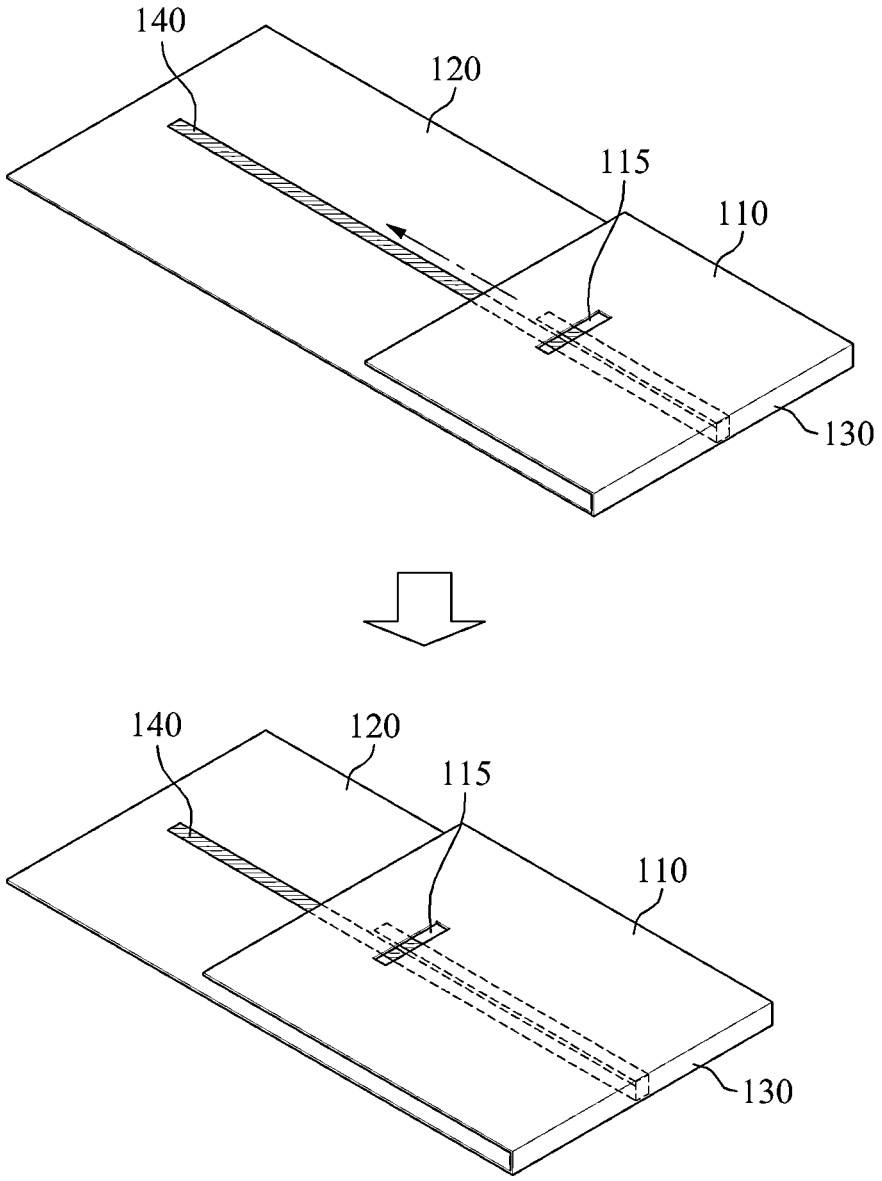
FIG. 7A is a perspective view illustrating an example of tuning of a resonant frequency based on a flexibility of an aperture-coupled microstrip antenna.

FIG. 7A is a perspective view illustrating an example of tuning of a resonant frequency based on a flexibility of the aperture-coupled microstrip antenna 100. When a quality (Q) factor is increased during design of the aperture-coupled microstrip antenna 100, a resonant frequency band is decreased. To improve such a narrow resonant frequency band, a device such as, for example, a capacitor or an inductor, may be replaced, or the resonant frequency may be adjusted by applying electrical direct current (DC) signals. However, the replacement of the device may cause a waste of processes. In addition, the application of the DC signals needs to be continuous.

Accordingly, in the aperture-coupled microstrip antenna 100, the radiating patch 110 may be mechanically pulled or pushed based on the flexibility of the aperture-coupled microstrip antenna 100 (e.g., the radiating patch 110, the ground plane 120, and the shorting wall 130) to vary the length of the radiating patch 110. As a result, the resonant frequency of the aperture-coupled microstrip antenna 100 may be more efficiently adjusted or tuned.

Figure 7B:
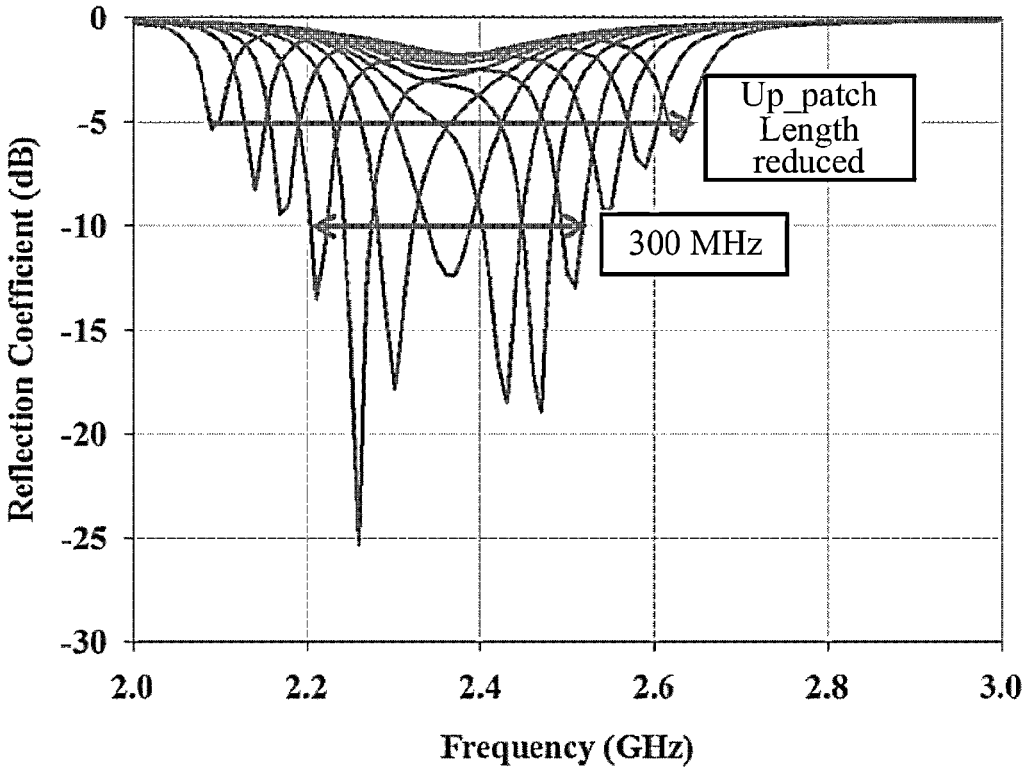
FIG. 7B is a graph illustrating an example of a reflection coefficient based on the tuning of the resonant frequency of FIG. 7A.

FIG. 7B is a graph illustrating an example of a reflection coefficient based on the tuning of the resonant frequency of FIG. 7A. As illustrated, a −10 dB bandwidth is increased to about 300 MHz through the adjustment of the length (e.g., "Up_patch Length") of the radiating patch 110.

Hereinafter, a manufacturing method for the aperture-coupled microstrip antenna 100 will be described. The manufacturing method may include integrally forming the radiating patch 110, the ground plane 120, and the shorting wall 130 with one another. However, as shown in the example of FIG. 1, the radiating patch 110, the ground plane 120, and the shorting wall 130 may be separately formed.

The manufacturing method for the aperture-coupled microstrip antenna 100 further includes forming the aperture 115 in the radiating patch 110. Since characteristics of the aperture-coupled microstrip antenna 100 may be varied based on a size and a position of the aperture 115, the aperture-coupled microstrip antenna 100 may be designed depending on circumstances. That is, a degree of freedom is high in the design of the aperture-coupled microstrip antenna 100.

In addition, the manufacturing method may include forming the microstrip feeder 140 on the radiating patch 110, the ground plane 120, and the shorting wall 130 that are integrally formed. Also, the manufacturing method may include folding the radiating patch 110, the ground plane 120, the shorting wall 130, and the microstrip feeder 140 together, e.g., with respect to the shorting wall 130. Thus, the manufacturing method may be facilitated in comparison to a conventional antenna manufacturing method. During the folding of the radiating patch 110, the ground plane 120, the shorting wall 130, and the microstrip feeder 140, the characteristics of the aperture-coupled microstrip antenna 100 may be varied based on a folding degree or an overlapping degree (e.g., a size) of the microstrip feeder 140. Therefore, the aperture-coupled microstrip antenna 100 may be designed appropriate for circumstances. After the folding of the radiating patch 110, the ground plane 120, the shorting wall 130, and the microstrip feeder 140, the microstrip feeder 140 is disposed between the radiating patch 110 and the ground plane 120.

According to the teachings above, there is provided an aperture-coupled microstrip antenna, which may efficiently generate electromagnetic coupling by a non-contact power feeding method using an aperture. In addition, the aperture-coupled microstrip antenna may be improved in radiation efficiency by including a unidirectional radiation pattern, an aperture disposed at a radiating patch, and a microstrip feeder disposed between the radiating patch and a ground plane. Being manufactured in a thickness of 1.5 mm or less, the aperture-coupled microstrip antenna is appropriate to be implanted in or attached to a surface of a human body.

The aperture-coupled microstrip antenna may be manufactured in a foldable type. Therefore, the aperture-coupled microstrip antenna may be manufactured with ease and in a small size. The foldable structure may enable convenient tuning of a resonant frequency.

Furthermore, a manufacturing method for an aperture-coupled microstrip antenna may provide a proper aperture-coupled microstrip antenna depending on use environments. Accordingly, a degree of freedom of design may be increased.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

For example, although the aperture-coupled microstrip antenna 100 has been described to be implanted in a human body or attached on a surface of a human body, features of the aperture-coupled microstrip antenna 100 include a high radiation efficiency achieved by excluding performance reduction, and a structure facilitating the manufacturing of the aperture-coupled microstrip antenna 100. Therefore, the aperture-coupled microstrip antenna 100 may be used not only for application to the human body but also all fields including an antenna technology.

What is claimed is:

1. An aperture-coupled microstrip antenna comprising:

a radiating patch comprising an aperture;

a ground plane disposed below the radiating patch;

a shorting wall connecting the radiating patch with the ground plane; and a microstrip feeder configured to apply electromagnetic waves to the aperture, wherein the microstrip feeder is disposed continuously on the radiating patch, the ground plane, and the shorting wall, wherein the microstrip feeder is inserted into a space in a folded state, and the space is formed by the radiating patch, ground plane, and shorting wall, wherein the radiating patch, the ground plane, and the shorting wall are integrally formed in a folded state, wherein the radiating patch, the ground plane, and the shorting wall comprise a flexible printed circuits board (FPCB), and wherein the radiating patch, the shorting wall, and the ground plane form a flattened U-shape.

2. The aperture-coupled microstrip antenna of claim 1, wherein the microstrip feeder is disposed between the radiating patch and the ground plane.

3. The aperture-coupled microstrip antenna of claim 1, wherein the radiating patch, the ground plane, and the shorting wall comprise respective surfaces of the aperture-coupled microstrip antenna.

4. The aperture-coupled microstrip antenna of claim 1, wherein a portion of the microstrip feeder overlaps with a remaining portion of the microstrip feeder.

5. The aperture-coupled microstrip antenna of claim 1, wherein the radiating patch, the ground plane, and the shorting wall comprise a material comprising a loss tangent of less than 0.025.

6. The aperture-coupled microstrip antenna of claim 1, wherein an inner space between the radiating patch and the ground plane is filled with air.

7. The aperture-coupled microstrip antenna of claim 1, wherein a thickness of the aperture-coupled microstrip antenna is less than or equal to 1.5 mm.

8. The aperture-coupled microstrip antenna of claim 1, wherein the aperture-coupled microstrip antenna is configured to:

generate a unidirectional radiation pattern.

9. The aperture-coupled microstrip antenna of claim 1, wherein the radiating patch is configured to:

be pulled and pushed based on a flexibility of the radiating patch to vary a length of the radiating patch, and to adjust a resonant frequency of the aperture-coupled microstrip antenna.

10. The aperture-coupled microstrip antenna of claim 1, wherein:

the radiating patch is configured to generate radiation based on the electromagnetic waves; and the ground plane is configured to exclude the radiation at a lower portion of the ground plane.

11. The aperture-coupled microstrip antenna of claim 1, wherein a width of the ground plane is in a range of 26 mm to 70 mm.

12. The aperture-coupled microstrip antenna of claim 1, wherein the radiating patch is shorter in length than the ground plane.

13. A manufacturing method for an aperture-coupled microstrip antenna, the manufacturing method comprising:

integrally forming a radiating patch, a ground plane, and a shorting wall;

forming an aperture in the radiating patch;

forming a microstrip feeder on the radiating patch, the ground plane, and the shorting wall; and folding the radiating patch, the ground plane, the shorting wall, and the microstrip feeder together in a folded state, wherein the microstrip feeder is integrally formed continuously on the radiating patch, the ground plane, and the shorting wall, wherein the microstrip feeder is inserted into a space in the folded state, and the space is formed by the radiating patch, ground plane, and shorting wall, wherein the radiating patch, the ground plane, and the shorting wall comprise a flexible printed circuits board (FPCB), and wherein the radiating patch, the shorting wall, and the ground plane form a flattened U-shape.

14. The manufacturing method of claim 13, wherein the radiating patch, the ground plane, and the shorting wall comprise a flexible printed circuits board (FPCB).

15. The manufacturing method of claim 13, further comprising:

folding the radiating patch, the ground plane, the shorting wall, and the microstrip feeder together with respect to the shorting wall.

16. A manufacturing method for an aperture-coupled microstrip antenna, the manufacturing method comprising:

forming a substrate;

forming a microstrip feeder on the substrate; and folding the substrate and the microstrip feeder together to form three surfaces of the aperture-coupled microstrip antenna in a folded state, wherein the microstrip feeder is integrally formed continuously on the three surfaces, wherein the microstrip feeder is inserted into a space in the folded state, and the space is formed by the three surfaces, wherein the three surfaces comprise a flexible printed circuits board (FPCB), and wherein the three surfaces form a flattened U-shape.

17. The manufacturing method of claim 16, further comprising:

forming an aperture in a top surface of the three surfaces.

* * * * *